US009643755B2

(12) United States Patent
Dunkle et al.

(10) Patent No.: US 9,643,755 B2
(45) Date of Patent: May 9, 2017

(54) PACKAGING

(71) Applicant: KRAFT FOODS R & D, INC., Deerfield, IL (US)

(72) Inventors: Christopher Wright Dunkle, Deerfield, IL (US); Jo-Ann Clark, Deerfield, IL (US); Adam Lloyd, Deerfield, IL (US)

(73) Assignee: KRAFT FOODS R&D, INC., Deerfield, IL (US)

( * ) Notice: Subject to any disclaimer, the term of this patent is extended or adjusted under 35 U.S.C. 154(b) by 0 days.

(21) Appl. No.: 14/389,030

(22) PCT Filed: Mar. 28, 2013

(86) PCT No.: PCT/US2013/034306
§ 371 (c)(1),
(2) Date: Sep. 29, 2014

(87) PCT Pub. No.: WO2013/148971
PCT Pub. Date: Oct. 3, 2013

(65) Prior Publication Data

US 2015/0063728 A1 Mar. 5, 2015

(30) Foreign Application Priority Data

Mar. 29, 2012 (GB) ..... 1205556.2

(51) Int. Cl.
*B65D 33/10* (2006.01)
*B65D 33/14* (2006.01)
(Continued)

(52) U.S. Cl.
CPC ..... *B65D 33/14* (2013.01); *B31B 1/00* (2013.01); *B31B 1/25* (2013.01); *B31B 1/90* (2013.01);
(Continued)

(58) Field of Classification Search
CPC .. B65D 33/14; B65D 75/008; B65D 75/5805; B65D 75/5855; B65D 33/08; B65D 33/20; B65D 77/38
(Continued)

(56) References Cited

U.S. PATENT DOCUMENTS 3,348,760 A * 10/1967 Hinsken ..... B65D 33/14 383/116
3,516,537 A * 6/1970 Griffiths ..... B65D 75/5805 206/497
(Continued)

FOREIGN PATENT DOCUMENTS

DE 202006017953 U1 2/2007
GB 2464265 A * 4/2010 ..... B65D 33/14
(Continued)

OTHER PUBLICATIONS

Machine translation of the description of JP 2006273334 A.*
(Continued)

*Primary Examiner* — Jes F Pascua
(74) *Attorney, Agent, or Firm* — Cantor Colburn LLP

(57) ABSTRACT

A flexible packaging bag is closed at one end by means of a header having a removable outer header portion and an inner header portion (16A) both of which are sealed. The seal in the inner header portion is peelable. An elliptical aperture is defined in the outer header portion. The aperture is dimensioned to enable the insertion of one or more fingers and is offset proximal to a first side edge of the outer header portion. The aperture is used to suspend the bag from a display hook at an angle and can be grasped as an aid to tearing when removing the outer header portion.

21 Claims, 6 Drawing Sheets

(51) Int. Cl.

| | |
|---|---|
| ***B65D 33/08*** | (2006.01) |
| ***B31B 1/25*** | (2006.01) |
| ***B31B 1/90*** | (2006.01) |
| ***B65B 1/02*** | (2006.01) |
| ***B65D 33/20*** | (2006.01) |
| ***B65D 77/38*** | (2006.01) |
| ***B31B 1/00*** | (2006.01) |

(52) U.S. Cl.
CPC ..... *B65B 1/02* (2013.01); *B65D 33/08* (2013.01); *B65D 33/20* (2013.01); *B65D 77/38* (2013.01)

(58) Field of Classification Search
USPC .... 383/9, 10, 201, 203, 204, 61.1, 61.2, 104
See application file for complete search history.

(56) References Cited

U.S. PATENT DOCUMENTS

| | | | | |
|---|---|---|---|---|
| 3,782,622 | A | 1/1974 | Montgomery | |
| 6,347,885 | B1 * | 2/2002 | Buchman | B65D 33/2591 383/203 |
| 6,866,420 | B2 * | 3/2005 | Buchman | B65D 33/2591 383/204 |
| 6,974,256 | B2 * | 12/2005 | Kinigakis | B65D 33/2591 383/204 |
| 2001/0017950 | A1 * | 8/2001 | Strand | B31B 19/90 383/204 |
| 2007/0104395 | A1 * | 5/2007 | Kinigakis | B65D 33/20 383/61.1 |
| 2007/0258663 | A1 | 11/2007 | Plourde et al. | |
| 2008/0063324 | A1 * | 3/2008 | Bernard | B65D 75/5811 383/200 |
| 2010/0084295 | A1 | 4/2010 | Eilert et al. | |
| 2011/0293208 | A1 * | 12/2011 | Cheema | B65D 33/14 383/205 |

FOREIGN PATENT DOCUMENTS

| | | | |
|---|---|---|---|
| JP | 2000025793 | A | 1/2000 |
| JP | 2004203400 | A | 7/2004 |
| JP | 2006273334 | A * | 10/2006 |
| JP | 2008120427 | A * | 5/2008 |
| WO | 2008033919 | A2 | 3/2008 |
| WO | 2010040984 | A1 | 4/2010 |
| WO | 2010059887 | A1 | 5/2010 |

OTHER PUBLICATIONS

ISR PCT/US2013/034306 dated Jul. 1, 2013.
Detailed First Office Action; Chinese Application No. 201380018201.8; Date of Mailing: Sep. 28, 2015; 11 Pages.
Office Action; European Application No. 13768587.1; Date of Mailing: Mar. 1, 2016; 4 Pages.
Office Action; Russian Application No. 2014138872; Date of Mailing: Feb. 15, 2017; 9 Pages.

* cited by examiner

PACKAGING

CROSS REFERENCE TO RELATED APPLICATIONS

This application claims priority to U.K. Patent Application No. GB1205556.2 filed on Mar. 29, 2012, the contents of which is incorporated herein by reference in its entirety.

TECHNICAL FIELD OF THE INVENTION

The present invention relates to packaging and in particular to the type of packaging comprising a bag of flexible material which is closed at one end by means of a seal to form a header. The invention relates in particular, but not exclusively to flexible bags in the form of pouches. The invention also relates to methods of manufacturing such packaging.

BACKGROUND TO THE INVENTION

It is known to provide packaging of the type in which a bag for containing one or more product items is formed from a flexible material sealed at one end by means of a, usually transverse, seal to define a header. Often, an aperture is formed in the header so that the package can be suspended from a hook or the like for display purposes. This type of packaging is commonly used to package flowable products such as liquids and powders or for containing a number of smaller product items such as: savoury snacks, nuts, dried fruit, small cookies, crackers, and confectionery products including gum pellets, mints, gums, hard boiled sweets, candies, chocolates, toffees, and the like. In some embodiments, the bag is in the form of a pouch. The pouch cavity may be gas flushed (e.g. N2 or CO2) before the bag is closed A problem with the known type of flexible packaging bags is that they can be difficult to open. A common method for opening packaging bags is to tear the material so as to remove all or part of the header. Materials commonly used to form such flexible bags include polymeric materials, metallic foil, and paper. Often the material will be a laminate having two or more layers of different materials. For packaging confectionery products, a commonly used laminate comprises an inner layer of paper and an outer layer of a metallic, often aluminium, foil. However, other materials have been used, including polymeric materials which may include thermoplastic materials such as polyethylene terephthalate (PET), for example. These materials offer good barrier properties but can be resistant to tearing, especially in a sealed header region. This makes opening such bags difficult as the material does not easily tear in a controlled fashion. In an effort to make it easier to open such bags, it is known to provide a tear initiation feature, such as a notch or slit, at one edge of the bag in or adjacent to the header. It is also known to form a line of weakness extending across the bag to define a preferred tear line. Even with the use of such features, successful opening of bags is dependent on the user being able grip the material and apply a sufficient force to initiate and propagate tearing. Users who are unable to grip the material with sufficient force, due possibly to age or infirmity, can still find it difficult to successfully open the known bags. Furthermore, many users find it difficult to identify the tear initiation feature and so do not apply an opening force in the intended region.

In addition to ease of opening, it is desirable for flexible packaging bags to be distinctively attractive to potential consumers. This is particularly so with packaging for confectionery and other snack type products which may be displayed at or close to a payment counter in a retail outlet in order to attract impulse purchases.

There is a need then for an improved flexible packaging bag which overcomes, or at least mitigates, some or all of the problems of the known packaging.

There is also a need for an improved flexible packaging bag which is distinctive and attractive to customers.

There is additionally a need for improved methods of manufacturing flexible packaging bags.

SUMMARY OF THE INVENTION

In accordance with a first aspect of the invention, there is provided a packaging bag of flexible material closed at one end by means of a seal to form a header, in which the header comprises a removable outer header portion and an inner header portion both of which are sealed, the seal in the inner header portion being a peelable seal, the outer header portion defining an oval aperture by means of which the packaging can be suspended for display purposes, the aperture being dimensioned to enable the insertion of one or more fingers by a user and offset proximal to a first side edge of the outer header portion.

The offset oval aperture can be used to suspend the bag from a display hook at an angle and as an aid to tearing when removing the outer header region.

The seal in the inner header portion may be a re-closable seal.

A tear initiation feature, such as a notch or slit, may be provided in said first side edge of the header between the inner and outer header portions. The oval aperture may be located proximal to the tear initiation feature. The oval aperture may be located above the tear initiation feature.

A line of weakness may extend across the header between the inner and outer header portions. The line of weakness may extend from an inner end of the tear initiation feature to a second side edge of the header opposite from the first.

The bag may be made from a material having directional tear characteristics, the material being orientated so as to tear preferentially across the header in a direction from the first side edge of the header to a second side edge opposite from the first.

The oval aperture may be aligned so that its major axis is angled relative to the longitudinal axis of the bag. The oval aperture may be aligned so that its major axis extends at an angle of between 30 to 60 degrees relative to the longitudinal axis of the bag. In an embodiment, the major axis of the oval aperture is angled downwardly in a direction towards the first side edge. The oval aperture may be aligned so that its major axis intersects the first side edge of the header at or proximal to the tear initiation feature.

The header may be shaped such it has a greater depth in a region in which the oval aperture is located than in a region proximal to a second side edge of the header opposite from the first side edge. The outermost edge of the header may be curved.

The bag may have base opposite from the header on which it can be stood in an upright position. The bag may be in the form of a pouch.

The oval aperture may be elliptical.

In accordance with a second aspect of the invention, there is provided a method of manufacturing a packaging bag in accordance with the first aspect, the method comprising forming the flexible bag from one or more sections of a flexible film material in a substantially continuous process.

The method may comprise clamping opposing sections of the film material between a pair of cross-seal jaws to form the header. One of the jaws may comprise a punch for producing the aperture in the outer header region when the film material is clamped between the jaws.

The method may comprise passing opposing sections of the film material between a pair of contra-rotating die wheels to form the header. At least one of the die wheels may have formations for producing one or more of: the oval aperture, a tear initiation feature in said first side edge of the header between the inner and outer header portions, and a line of weakness extending across the header between the inner and outer header portions.

The method may comprise forming a series packaging bags from a roll of film material using a form-fill-seal apparatus, which may be a vertical or a horizontal form-fill-seal apparatus. The method may comprise clamping opposing sections of the film material between a pair of cross-seal jaws to simultaneously form the header of one bag and a base seal of a further bag.

BRIEF DESCRIPTION OF THE FIGURES

Several embodiments of the invention will now be described, by way of example only, with reference to the accompanying drawings, in which.

DETAILED DESCRIPTION OF THE INVENTION

Figure 2:
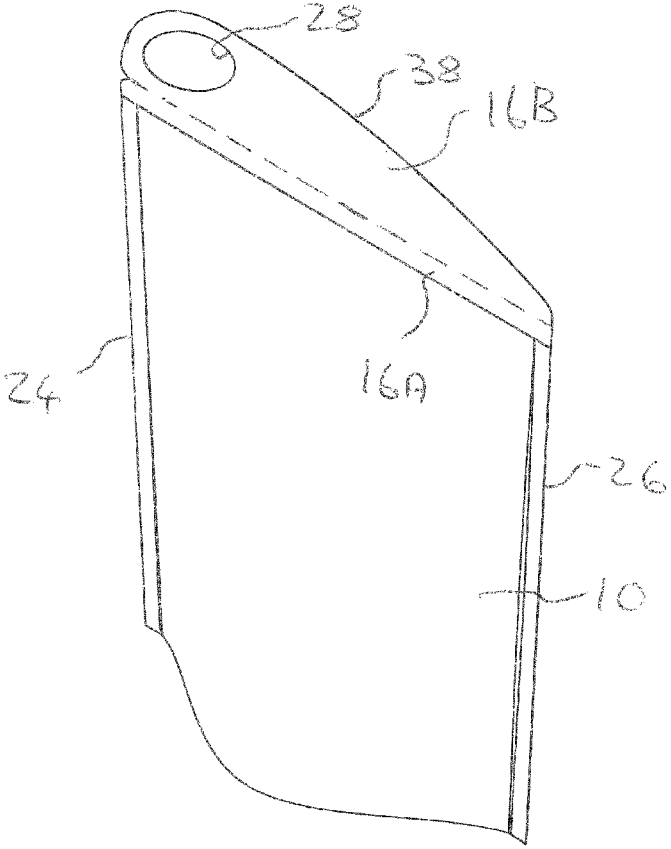
FIG. 2 is a perspective view of the packaging bag of FIG. 1.

The same reference numerals but increased by 100 in each case will be used to identify the same features or features that perform the same function in each of the embodiments described.

Figure 1:
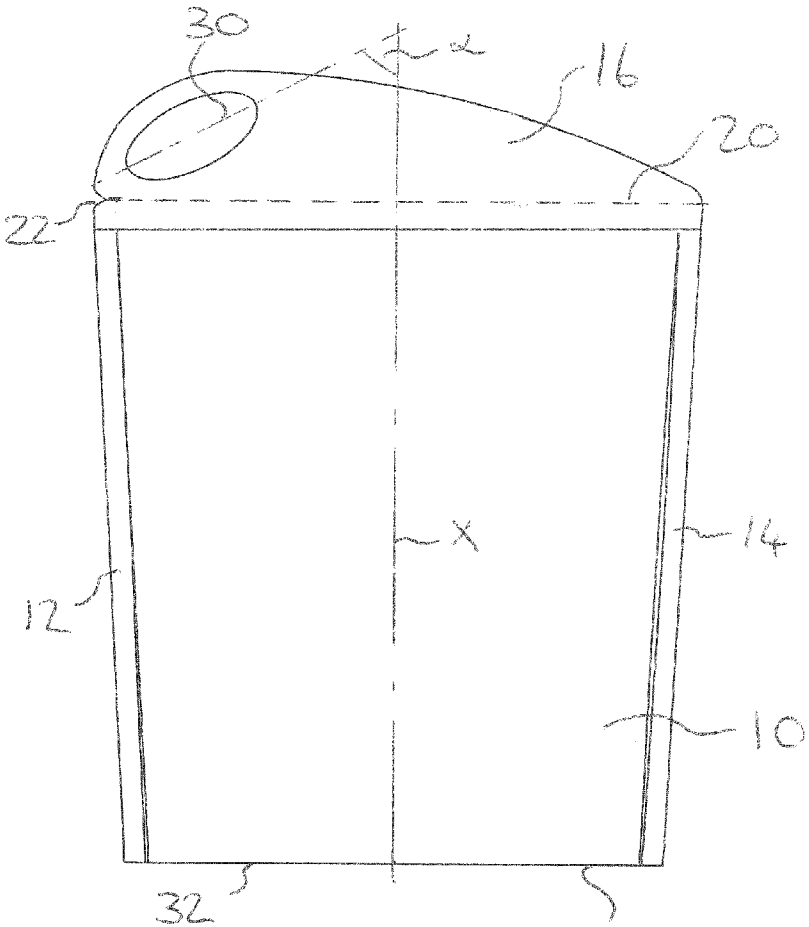
FIG. 1 is a front elevation of a packaging bag in accordance with a first embodiment of the invention.

With reference initially to FIGS. 1 and 2, a packaging bag 10 in accordance with the invention is formed from a flexible film material and has side seals 12, 14, a sealed header 16 and a base 18. The bag 10 defines an enclosed interior volume in which product is held. In the present embodiment, the pouch 10 is a so called stand-up pouch which is designed to stand upright on its base 18. The bag 10 could be manufactured as a doy-style pouch, a flat bottom bag, a brick-style pouch, a quad bag or a gusseted pouch. However, the invention is not limited to stand-up pouches and bags but can be equally applied to any flexible packaging bag having a sealed header region.

The packaging bag 10 can be manufactured using any suitable methods and apparatus but will often be produced using form-fill-seal techniques and machinery which may be vertical or horizontal as appropriate. The packaging bag can be manufactured from any suitable flexible film material which may comprise polymeric materials such as polyethylene (e.g. PET, LLDP) and polypropylene, metallic foil, and paper. The film material may also be a laminated material.

A line of weakness 20 extends across the header 16 to divide it into an inner portion 16A and an outer portion 16B. In the present embodiment, the line of weakness 20 is provided by means a line of perforations extending across the width of the header 16 but other methods for forming the line of weakness can be used, such as laser etching or mechanical scoring for example. A tear initiation feature 22 in the form of a V shaped notch is provided at a first side edge 24 of the header so that a user can more easily initiate tearing along the line of weakness in a known manner. The line of weakness 20 extends fully across the header 16 from the notch 22 to a second side edge 26 of the header opposite from the first 24 so that the outer header portion 16B can be fully removed by tearing along the line of weakness when initially opening the bag 10. The tear initiation feature 22 need not be a V shaped notch but could take other forms such as a slit or an alternatively shaped notch. Both the inner and outer header portions 16A, 16B are sealed, so that the package remains sealed by virtue of the inner header portion 16A when the outer header portion 16B is initially removed.

A display aperture 28 is defined within the outer header portion 16B. The aperture is elliptical in shape and is located off-centre, proximal to the first side edge 24 of the header and also proximal to the tear initiation feature 22. The aperture 28 aligned so that its major axis 30 is angled relative to a longitudinal axis X of the packaging bag, the longitudinal axis X being a line drawn perpendicular to a lower edge 32 of the bag through the centre of the bag. Alternatively, the longitudinal axis X can be considered to be a line extending vertically though the centre of the bag 10 when the bag is stood upright on its base 18 on a horizontal surface. The elliptical aperture 28 is aligned so that its major axis 30 is angled downwardly in a direction towards the first side edge 24 of the header at an angle $\alpha$ of between 30 to 60 degrees to the longitudinal axis X. In an embodiment, the elliptical aperture 28 is aligned so that its major axis 30 is angled downwardly in a direction towards the first side edge 24 of the header at an angle $\alpha$ of about 45 degrees to the longitudinal axis X.

Figure 4:
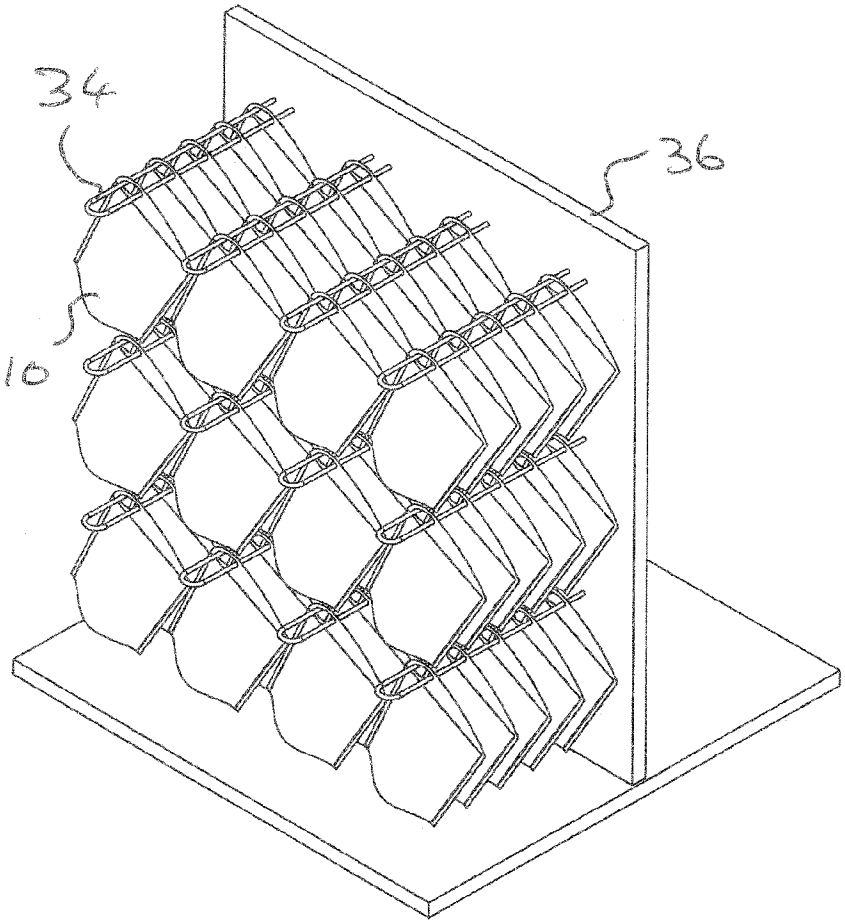
FIG. 4 is a perspective view of the retail display stand of FIG. 3.
Figure 3:
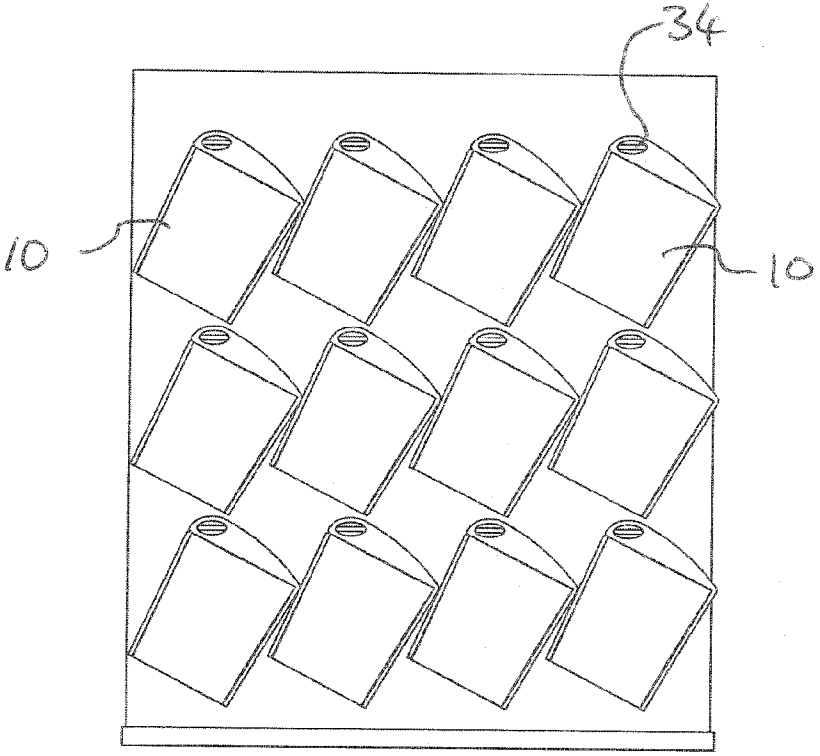
FIG. 3 is front view of a retail display stand on which a number of packaging bags in accordance with the invention are suspended.

Because the elliptical aperture 28 is off-set to one side and is angled, the bag 10 will tend to hang at an angle when suspended from a Euro-hook 34 inserted through the aperture 28, as is illustrated in FIGS. 3 and 4. In the embodiment where the major axis of the aperture 28 is angled at about 45 degrees to the longitudinal axis, the bag 10 will tend to hang at an angle of about 45 degrees to the vertical. That is to say, the bag 10 will hang so that its longitudinal axis X is off-set from the vertical by about 45 degrees. As can be seen from FIGS. 3 and 4, when a plurality of packaging bags 10 in accordance with the invention are suspended at an angle on a display 36, it creates an interesting and distinctive effect when compared to conventional arrangements in which packaging bags are suspended generally upright. The unusual display effect is accentuated by the elliptical shape of the aperture 28 whose major axis 30 is aligned horizontally when the bag 10 is suspended on a Euro-hook. In the present embodiment, the outer or upper edge 38 of the outer header portion is curved and the header portion is shaped so as to have a greater depth, measured in the longitudinal direction of the bag (i.e. parallel to the longitudinal axis X), that is greater in a region adjacent the first side edge 24 in which the display aperture 28 is located than in a region adjacent to second side edge 26. This also contributes to the visual display effect.

In addition to providing an unusual design and display feature, the off-set elliptical aperture 28 in the outer header portion also provides a mechanical aid in initiating tearing along the line of weakness 20 to remove the outer header portion 16B. The aperture 28 is dimensioned so that a user can insert one or more fingers/thumbs in the aperture and, whilst also holding the bag below the line of weakness, pull the material in the outer header portion 16*b* surrounding the aperture across the top of bag 10 to initiate and then propagate a tear along the line of weakness 20. This makes it easier for a user to apply sufficient force to remove the outer header portion 16B, even if they are infirm/elderly or have wet hands that would otherwise make it difficult to grasp the material. The location of the aperture 28 adjacent to the tear initiation feature 22 ensures that the user is automatically drawn to start the tear at the correct location without the need to closely inspect the package. The shape and angle of the aperture 28 also serve to draw the user's attention to the tear initiation feature. In this regard, the aperture 28 may be aligned so that its major axis 30 is directed towards the first side edge 24 at a location proximal to the tear initiation feature 22, or indeed towards the tear initiation feature itself 22, as a further visual aid to the user in identifying the correct position at which the tear should be initiated. Reference to the aperture being dimensioned so that a user can insert one or more fingers/thumbs in the aperture, assumes that the user is an adult human being with average sized fingers/thumbs.

In use, the package 10 is hung up for display using the aperture 28. Once an end user or consumer has removed the package 10 from its display, the outer header portion 16B with the display aperture 28 is removed by tearing along the line of weakness 20 using the aperture 28. At this stage the package remains sealed by virtue of the inner header portion 16A which can be peeled apart to open the package. For example, the consumer could open the inner header seal 16A by grasping opposing main sides of the package and pulling them apart to peel the opposing sides of the inner header portion 16A apart. Alternatively, the outer edges of the opposed sections of film that form the inner header portion 16A may not be sealed close to line of weakness 20. With this arrangement, once the outer header portion 16B has been removed, a user can grasp the free edges of the opposed sections of film and pull them apart to open the package.

The seal in the header 16 can be formed in a number of ways. In one embodiment, the film material is heated under pressure so that the opposing sections of material that form the header 16 are fused together to produce a welded seal. Both the outer header portion 16B and the inner header portion 16A may have welded seals. Alternatively, at least the seal in the inner header portion 16A can be formed using a peelable adhesive. The peelable adhesive can be of any suitable type and may be heat and/or pressure sensitive. In one embodiment, the inner header portion 16A is sealed using a peelable and re-sealable adhesive. This is advantageous as it enables the inner header portion 16A to be re-closed after the package has been opened.

The outer header portion 16B may also be sealed using an adhesive. Where adhesive is used to seal the outer header portion 16B, the adhesive may be a permanent adhesive or a peelable adhesive. In one embodiment, the same peelable adhesive is used to seal both the inner and outer header portions 16A, 16B. This significantly simplifies the manufacturing process and hence reduces manufacturing costs. A peelable adhesive can be used in the outer header portion 16B because it is usually larger than the inner header portion 16A and so has a larger amount of adhesive applied to it. This forms a tight bond and makes it difficult to pull the outer header portion 16B apart. In contrast, a relatively small strip of peelable adhesive will usually be used to seal the inner header portion 16A, which is relatively easier to peel apart. Furthermore, since the outer header portion 16B takes all the strain when the package is hung on a Euro-slot arm or other hook, the peelable seal formed in the inner header portion 16A is left intact. It may be particularly advantageous if the same peelable adhesive is used to form all the seals in the package including any base or side seals and both the inner and outer header seals.

In a further alternative embodiment (not shown) inner header portion 16A may be sealed without using an adhesive or welding but by means of an alternative peelable sealing means. For example, a zip lock, finger press sealing strip, grip seal or other similar mechanical sealing means can be used to form the seal in the inner header portion.

Where the inner header portion 16A is sealed by means of a re-sealable adhesive or an alternative re-sealable sealing means, the package 10 can be re-closed by pressing opposing sides of the inner header portion 16A together. This enables the remaining contents to be safely retained within the re-closed package. References to a re-sealable adhesive should be understood as encompassing adhesives that can be used to re-close the packaging by holding the opposed sides of the inner header portion together so as to safely retain the contents without necessarily forming a hermetic seal.

Figure 6:
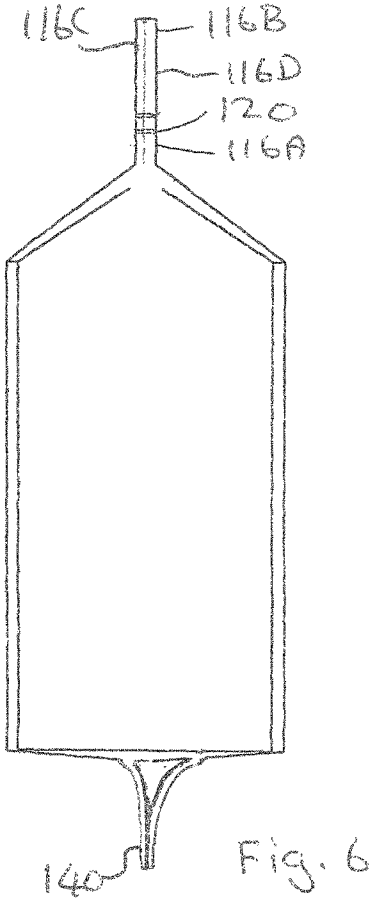
FIG. 6 is a side view of the packaging bag of FIG. 5.
Figure 5:
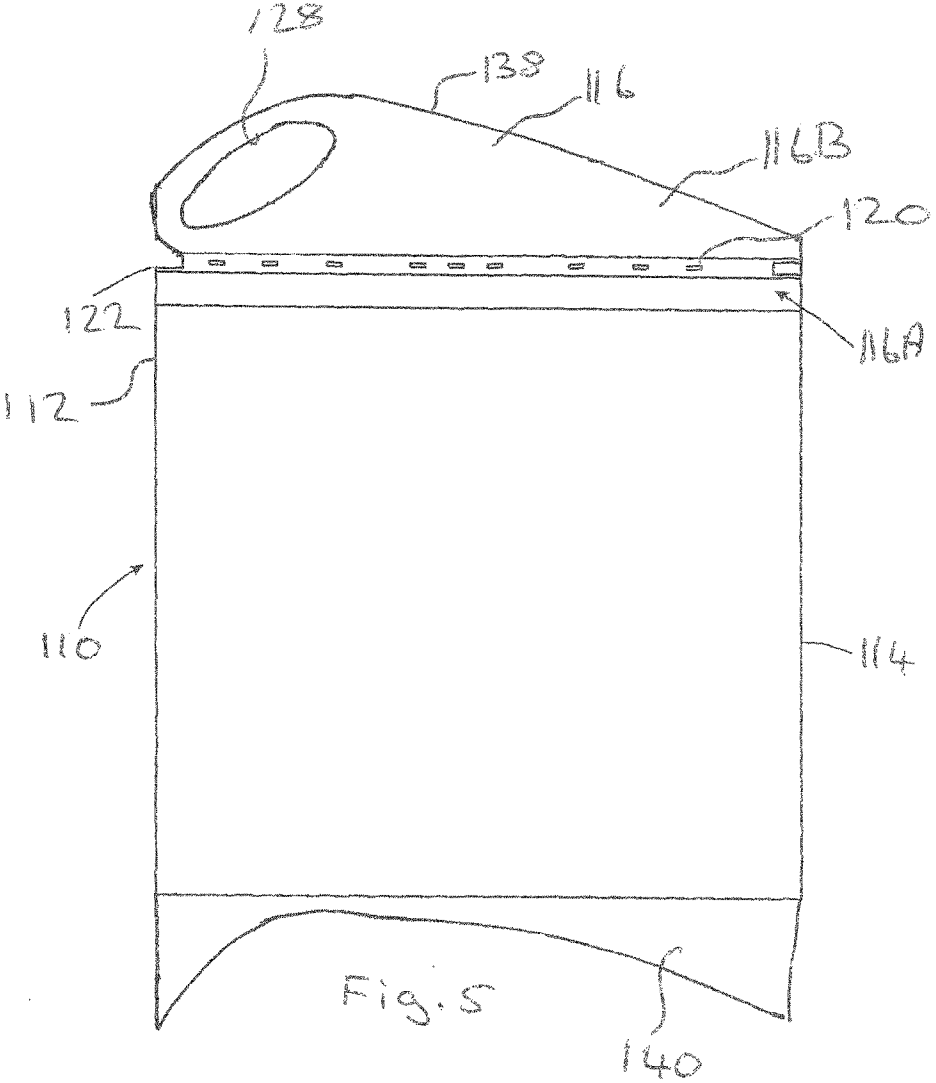
FIG. 5 is a front elevation of a packaging bag in accordance with a second embodiment of the invention.
Figure 7:
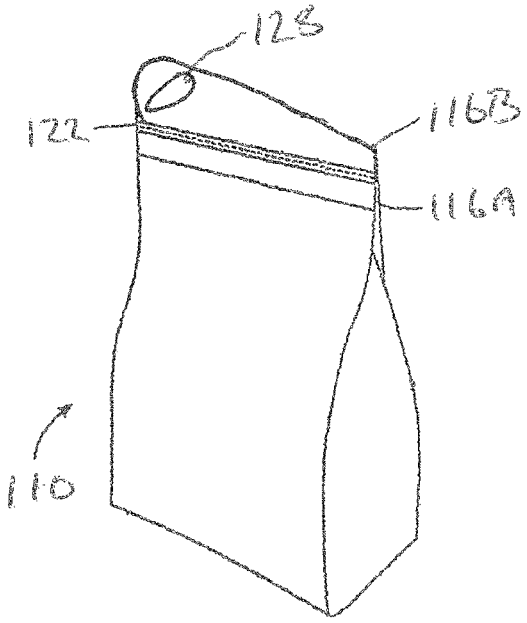
FIG. 7 is a perspective view of the packaging bag of FIG. 5.

As discussed above, a flexible packaging bag 10 in accordance with the invention can be manufactured using any suitable methods and apparatus including form-fill-seal techniques and machinery which may be vertical or horizontal as appropriate. FIGS. 5 to 7 illustrate a further embodiment of a packaging bag 110 in accordance with the invention which is in the form of a quad type bag produced using a vertical form-fill-seal apparatus as illustrated schematically in FIG. 8.

The packaging bag 110 is similar to the packaging bag 10 of the first embodiment having a sealed header 116 divided into an inner header region 116A and a removable outer header region 116B by a line of weakness 120. A tear initiation notch 122 is provided at a first side edge of the header 124. An elliptical aperture 128 is located in the outer header region offset proximal to the first side edge 124 and the tear initiation feature. The elliptical aperture 128 is angled in the manner described in relation to the first embodiment so that its major axis slopes downwardly toward the first side edge 124 and the tear initiation feature 122. The packaging bag 110 is closed at its lower end opposite from the header 116 by means of a transverse base seal 140. The base seal 140 is shown extended in FIGS. 5 and 6 but it may be folded over to one side to leave a flat bottomed bag.

Figure 9:
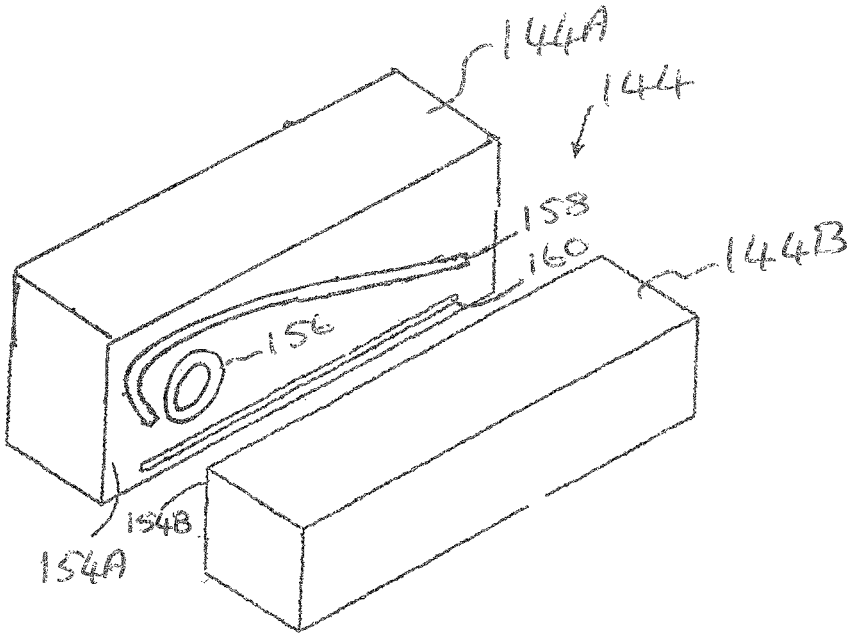
FIG. 9 is a perspective view of a pair of cross seal jaws forming part of the apparatus of FIG. 7.
Figure 8:
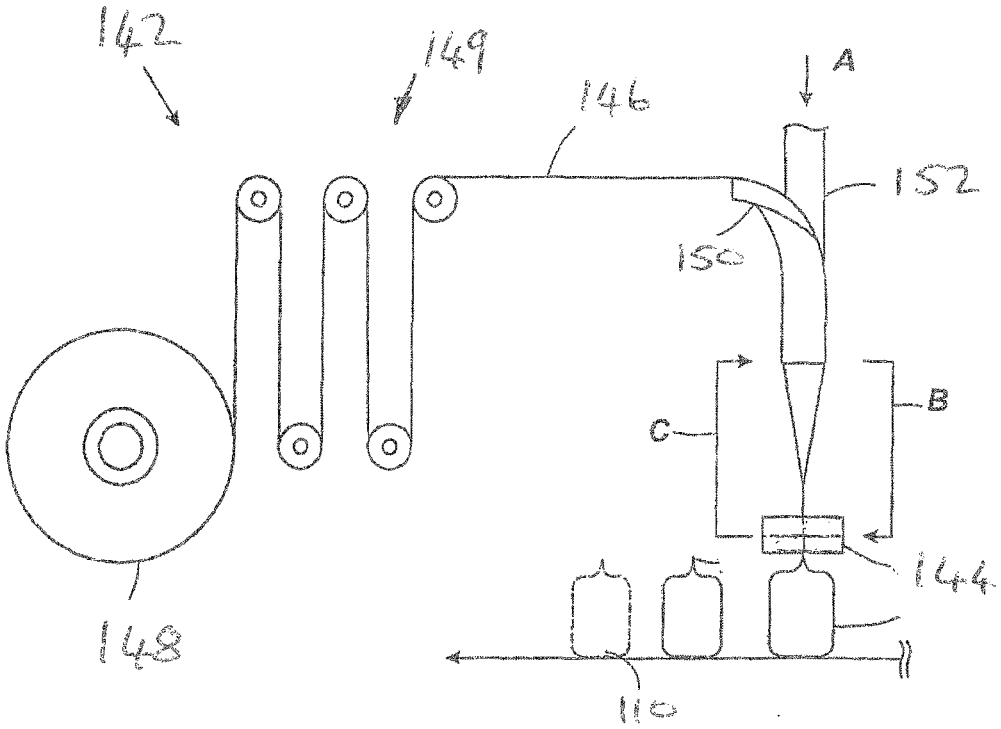
FIG. 8 is a schematic illustration of a vertical form-fill-seal apparatus for producing the packaging bag of FIGS. 5 to 7.

Vertical form-fill-seal apparatus 142 suitable for manufacturing the packaging bag 110 is illustrated in FIGS. 8 and 9. As part of the method of manufacture, header 116 is formed by compressing opposed sections 116C, 116D of the film material between a pair of cross-seal jaws 144. In this embodiment, the jaws 144 are also used to produce the complementary transverse base seal 140.

As illustrated in FIG. 8, a film 146 of flexible packaging material is drawn from a reel 148 through a set of tensioning rollers 149 and passed over a forming shoulder 150 to shape the film into a cylinder. The cylindrically formed film is then passed over a filling tube 152 through which the products to be packaged are introduced into each package in turn, as indicated by arrow A. Whilst the film 146 is passing over the cylinder, overlapping longitudinal edges of the film are sealed together to produce a longitudinal seal to close along the length of the cylindrical tube of film. The cross-seal jaws 144 are clamped about the cylindrical film at the base of the filling tube 152 to produce a header region 116 to seal one package after it has been filled and to produce a transverse seal 140 at the base of the next package. Whilst still in a clamped condition, the jaws are moved downwardly, as indicated by the arrow B in FIG. 7, drawing the film with them so that the next partially formed package is maneuvered into a filling position. During this process a knife or other cutting device is used to separate the filled package from the base seal 140 of next package. The jaws 144 are then separated and moved upwardly, as indicated by arrow C to clamp the film at the base of the filling tube 152 once the next package is filled and the process is repeated. The jaws 144 may be shaped so as to produce a curved header 116, with the base seal having a complementary shape as illustrated in FIG. 5.

The cross-seal jaws 144 may be heated to produce welded header and base seals or if a heat sensitive adhesive is used. However, where the header and base seals are produced using a cold seal adhesive, the jaws may just apply a pressure to form the header seal. Alternatively, part of the jaws may be heated and part not. For example, if the inner header seal is formed using a cold seal adhesive, the part of the jaws that form the inner header seal may not be heat whilst some or all of the rest of the jaws are heated to form the outer header portion and/or the base seal.

The jaws 144 are shown in more detail in FIG. 9 and have opposing surfaces 154A, 154B which are brought together to clamp the film in between when forming the header 116 and base seals 140. One of the jaws 144A may have a cutting formation or punch 156 projecting from its opposing surface and which passes through the film to contact the opposing surface of the other jaw 144B when the jaws are clamped about the film to form the elliptical display aperture 128.

The cross-seal jaws 144 could be used in conjunction with a first knife (not shown) which is operative to separate each filled and sealed bag from the film whilst the jaws are clamped and which produces the outer or upper edge 138 of the outer header region 116B. The jaws thus may have a first knife guide 158 in the form of a slot through one of the jaws 114A through which the first knife is introduced to cut the film material, the first knife guide 158 being located between a lower part of the jaws which forms the header 116 of one bag and an upper part which forms the base seal 140 of the next bag but outboard or above the punch 156 which forms the aperture 128. The other jaw 144B can be provided with a corresponding first knife guide groove (not shown) in its opposing surface into which a part of the first knife can enter as it cuts the film. Where the outer edge 138 is curved, the first knife guide 158 is correspondingly shaped.

The cross-seal jaws could also be used in conjunction with a second knife (not shown) for producing the line of weakness 120. In this case, the cross-seal jaws may have a second knife guide 160 in the form of a further through slot in one of the jaws 114A through which the second knife can be introduced to form the line of weakness. The other jaw may have a corresponding second knife guide groove in its opposing surface into which a part of the second knife can enter as it cuts the film. The second knife may be shaped to form a line of perforations. The jaws may also have a formation for producing the tear initiation feature 122. This may be in the form of a punch similar to that used to form the aperture or the tear initiation feature 122 could be produced by the second knife.

Whilst the jaws 144 are clamped together, a first knife or other cutting device (not shown) is inserted through the first knife guide 158 to cut the film separating the filled and sealed packaging bag 110 from the remainder of film and a second knife or other cutting or scoring device (also not shown) is inserted through the second knife guide 160 to form the line of perforations 120.

The term "knife" is used herein (including the claims) to mean any suitable cutting device for cutting the film or producing the line of perforations 120 as appropriate and should be construed accordingly. In relation to the second knife at least, the term is also intended to cover devices for scoring the material to produce a line of weakness. The term "knife guide" should also be construed as covering a guide for any suitable cutting or scoring means.

In alternative arrangements, a pair of cross seal jaws similar to the jaws 144 as described could be used to form a header 16, 116 only. This might be appropriate where a packaging bag in accordance with the invention does not have a transverse base seal or where other means are used to produce the base seal.

The use of a pair of cross-seal jaws 144 as described above in a continuous vertical form-fill-seal method and apparatus is a convenient arrangement for producing a packaging bag 10, 110 in accordance with the invention but it should be understood that a packaging bag 10, 110 in accordance with the invention can be produced by any suitable method. For example, the header region 16, 116 could be formed using a pair of contra-rotating die wheels with suitable formations for producing the aperture 28, 128. The contra-rotating die wheels may also have formations for shaping the outer or upper edge 38, 138 of the outer header region 16B, 116B, and/or producing the line of weakness 20, 120 and/or the tear initiation feature 22. 122.

Figure 10:
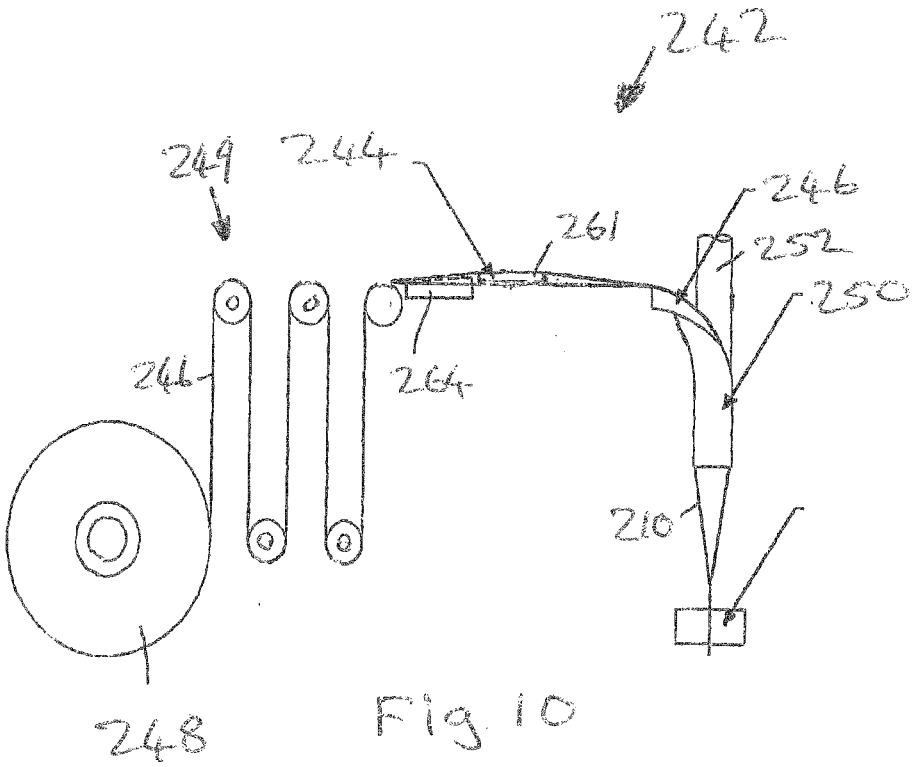
FIG. 10 is a schematic illustration of an alternative vertical form-fill-seal apparatus for producing packaging bags in accordance with the invention; and, FIG. 11 is a detailed view of part of the apparatus of FIG. 10 used to form header regions in a packaging bag in accordance with the invention.
Figure 11:
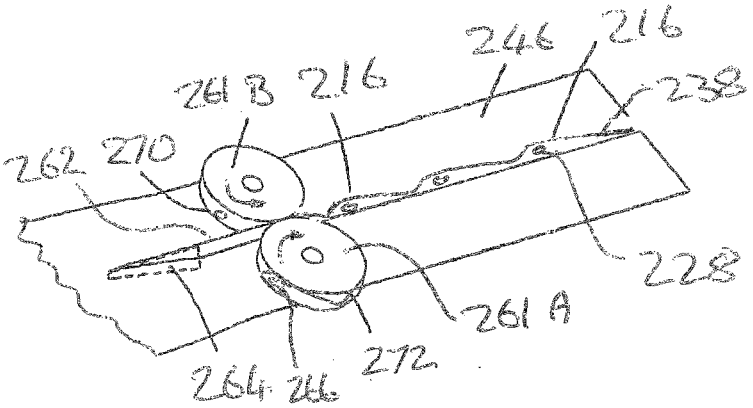

FIGS. 10 and 11 illustrate schematically use of a pair of contra-rotating die wheels 261 to produce a header 216 in an alternative vertical form-fill-apparatus 242. In apparatus 242, the die wheels 261A, 261B are arranged to form a series of header regions 216 in a film of material 246 before the film is formed into packaging bags 210. In this case, each packaging bag 210 is filled through a side. This method and apparatus is described in International patent application publication No. WO2010040984 (A1) to which the reader should refer for further details. The contents of WO2010040984 (A1) are hereby incorporated by reference.

As illustrated in FIGS. 10 and 11, the film material 246 is drawn from a roll 148 and passed through a set of tensioning rollers 249. A fold 262 is created along the centre of the material 246 by a folding means in the form of an upstanding elongated finger 264, which is positioned in the centre of the material 246 immediately preceding but on the opposite side of the material 246 to a pair of contra-rotating die wheels 261. The finger 264 is arranged to lift the centre of the material 246 sufficiently so as to form a fold 262 down the centre of the material 246. If desired, an upturned "v" or "u" shaped folding guide (not shown) can be provided over the finger 264 and the material 246, so as to contour the centre of the material 246 in the correct manner, prior to the fold 262 being permanently sealed by the contra-rotating wheels 261 as will be described below.

The contra-rotating die wheels 261 comprise a first wheel 261A which is disposed with its circumference adjacent to and almost touching that of a second wheel 261B. The first wheel 261A includes a first cutter 266 in the shape of the aperture 228 (i.e. an angled elliptical hole) projecting from its outer circumferential surface 268. In this embodiment, the second wheel 261B has an aperture 270 which is of a complementary shape to, and able to receive, the first cutter 266 when both wheels 261A, 261B are rotating. Additionally, if desired, the aperture 270 may contain a punch (not shown) configured to push out any waste material 246 from the aperture 228 when the second wheel 261B has been rotated away from the first cutter 266. The first wheel also has a second cutter 272 which is profiled to shape the outer edge 238 of the header.

In use, the first and second wheels 261A, 261B are configured to rotate in opposite directions such that when the fold 262 is fed between the first and second wheels, it is stamped by the first and second cutters 266, 272 every time they pass before the second wheel 261B. Accordingly, the first and second cutters 266, 272 will create successive apertures 228 and profiled outer edges 238 in the fold 262 at a pre-determined spacing along the roll of material 246 so as to provide an appropriate aperture 228 and profiled header 216 in the desired place on each successive bag 210 once formed. The wheels could also be provided with cutting formations to produce a line of weakness and a tear initiation feature for each bag in the header regions 216.

At least one of the wheels could be heated so as to heat seal the fold 262 together as it passes between the wheels 261. Alternatively, adhesive could be applied to the material either before the fold is created or just upstream from the wheels so that the fold is adhesively bonded together after passing between the wheels.

It should be noted that FIG. 11 actually illustrates the underneath view of the material 246 since, in practice, the header regions 216 must be provided on the outer surface of the material 246 as it is being formed into a tube of material by the forming shoulder 250. It should also be noted that in this embodiment, the header regions 216 are formed along a vertical edge of the tube of material, as viewed in FIG. 10. As the material is formed into a cylinder about the feeding tube 252, opposing edges of the material are bonded together to form a base seal opposite the header. Seals along opposite sides of the bag are formed by a pair of clamping jaws 244 which also pull the material 246 down as each bag is formed in a manner similar to that for conventional vertical for-fill-seal apparatus.

In a further alternative, the line of weakness 20 may be formed by laser scoring. Indeed, the curved edge 38 of the outer header may also be produce using a laser cutter as may the elliptical aperture 28.

The above embodiments are described by way of example only. Many variations are possible without departing from the scope of the invention as defined in the appended claims. For example rather than having a line of weakness 20, 120 extending across the header 16, 116, 216 the film material may have directional tear characteristics and the material may be oriented so as to tear preferentially in a direction transversely across the header from the first side edge 24, 124 to the second side edge 26, 126 of the bag. In this embodiment, once tearing has been initiated at the first side edge using the tear initiation feature 22, 122, it will tend to propagate across the header to the second side edge 26, 126 without the need for a line of weakness. Materials with directional tear characteristics tend to tear preferentially in one direction so that once a tear is initiated in the preferred direction; the tear will tend to propagate in a substantially straight line in the preferred direction. Materials with directional tear characteristics include oriented polymeric materials and laminates including at least one layer of oriented polymeric material. A suitable oriented polymeric material is a monoaxially orientated polypropylene (OPP) film. Monaxially orientated polypropylene films have a reduced tear strength in the direction of orientation and so will tend to tear preferentially in that direction once tearing has been initiated. A further suitable material would be a lamination comprising an outer layer of polyethylene terephthalate (PET), an inner layer of an orientated plastics film (such as Terolen®), with a layer of aluminium foil between the outer and inner layers. Other suitable materials can be used provided the material selected has directional tear characteristics.

It should also be noted that the aperture 28 need not be elliptical but could be any suitable oval shape.

The invention claimed is:

1. A packaging bag of flexible material closed at one end by means of a seal to form a header, in which the header comprises a removable outer header portion and an inner header portion, the outer header portion including an outer header seal and the inner header portion including an inner header seal, the inner header seal being a peelable seal, the outer header portion defining an oval aperture extending through a thickness of the outer header portion, by means of which the packaging can be suspended for display purposes, wherein the aperture is positioned to be offset from the peelable seal and absent any sealing and closure structures within an entire open area defined by the aperture, and wherein the aperture is dimensioned to enable the insertion of one or more fingers and offset proximal to a first side edge of the outer header portion, wherein the header is shaped such it has an area of greater depth in a region in which the oval aperture is located than in a region proximal to a second side edge of the header opposite from the first side edge, in which the outermost edge of the header is curved in the area of greater depth in a manner that substantially follows a curvature of the oval aperture.

2. The packaging bag as claimed in claim 1, wherein the peelable seal is re-closable.

3. The packaging bag as claimed in claim 1, wherein a tear initiation feature is provided in said first side edge of the header between the inner and outer header portions.

4. The packaging bag as claimed in claim 3, in which the oval aperture is located proximal to the tear initiation feature.

5. The packaging bag as claimed in claim 3, wherein the bag is made from a material having directional tear characteristics, the material being orientated so as to tear preferentially across the header in a direction from the first side edge of the header to a second side edge opposite from the first.

6. The packaging bag as claimed in claim 1, wherein a line of weakness extends across the header between the inner and outer header portions.

7. The packaging bag as claimed in claim 6, wherein a tear initiation feature is provided in said first side edge of the header between the inner and outer header portions, and wherein the line of weakness extends from an inner end of the tear initiation feature to a second side edge of the header opposite from the first.

8. The packaging bag as claimed in claim 1, wherein the oval aperture has a major and a minor axis, the aperture being aligned so that its major axis is angled relative to the longitudinal axis of the bag.

9. The packaging bag as claimed in claim 8, wherein the oval aperture is aligned so that its major axis extends at an angle of between 30 to 60 degrees relative to the longitudinal axis of the bag.

10. The packaging bag as claimed in claim 8, wherein the major axis of the oval aperture is angled downwardly in a direction towards the first side edge.

11. The packaging bag as claimed in claim 8, wherein a tear initiation feature is provided in said first side edge of the header between the inner and outer header portions, and wherein the oval aperture is aligned so that its major axis if extended would intersect the first side edge of the header at or proximal to the tear initiation feature.

12. The packaging bag as claimed in claim 1, wherein the bag has base opposite from the header region on which the bag can be stood in an upright position.

13. The packaging bag as claimed in claim 1, in which the bag is in the form of a pouch.

14. The packaging bag as acclaimed in claim 1, wherein the oval aperture is elliptical.

15. A method of manufacturing a packaging bag as claimed in claim 1, the method comprising forming the flexible bag from one or more sections of a flexible film material in a substantially continuous process.

16. The method as claimed in claim 15, the method comprising clamping opposing sections of the film material between a pair of cross-seal jaws to form the header.

17. The method as claimed in claim 16, wherein one of the jaws comprises a punch for producing the aperture in the outer header region when the film material is clamped between the jaws.

18. The method as claimed in 15, the method comprising passing opposing sections of the film material between a pair of contra-rotating die wheels to form the header.

19. The method as claimed in claim 18, at least one of the die wheels having formations for producing one or more of: the oval aperture, a tear initiation feature in said first side edge of the header between the inner and outer header portions, and a line of weakness extending across the header between the inner and outer header portions.

20. The method as claimed in claim 15, the method comprising forming a series packaging bags from a roll of film material using a form-fill-seal apparatus.

21. The method as claimed in claim 20 when dependent on claim 18, in which the method comprises clamping opposing sections of the film material between a pair of cross-seal jaws to simultaneously form the header of one bag and a base seal of a further bag.

* * * * *